United States Patent [19]

Dickson et al.

[11] 4,165,191

[45] Aug. 21, 1979

[54] WEB FEED, WEB CUTTING AND RIBBON FEED MEANS FOR A STATIONERY MOSAIC PRINTER

[75] Inventors: Stanley J. Dickson; Albert E. Castleton, both of Uxbridge, England

[73] Assignee: Control Systems Limited, Uxbridge, England

[21] Appl. No.: 745,827

[22] Filed: Nov. 29, 1976

[30] Foreign Application Priority Data

Dec. 2, 1975 [GB] United Kingdom ..... 49528/75

[51] Int. Cl.[2] ..... B41J 13/02

[52] U.S. Cl. ..... 400/636; 400/42; 400/124; 400/219.1; 400/219.5; 400/221.1; 400/224; 400/470; 400/583.2; 400/606; 400/641; 400/621; 400/656; 400/708

[58] Field of Search ..... 197/1 R, 151, 168, 165, 197/133 A, 150, 22, 133 R, DIG. 5; 101/93.04, 93.05

[56] References Cited

U.S. PATENT DOCUMENTS

| | | | |
|---|---|---|---|
| 588,493 | 8/1897 | Sinclair | 197/22 |
| 1,407,424 | 2/1922 | Jensen | 197/133 R |
| 1,623,366 | 4/1927 | Strawn | 197/150 |
| 1,658,723 | 2/1928 | Jensen | 197/DIG. 5 |
| 1,804,608 | 5/1931 | Hagemann | 197/DIG. 5 |
| 1,815,063 | 7/1931 | Johnson | 197/DIG. 5 |
| 2,247,912 | 7/1941 | Johnson | 197/133 R X |
| 2,276,991 | 3/1942 | Long et al. | 197/133 A |
| 2,869,455 | 1/1959 | Knutsen | 101/93.05 |
| 3,420,166 | 1/1969 | Ellis et al. | 197/133 R X |
| 3,825,681 | 7/1974 | Cederberg et al. | 178/23 R |
| 3,843,955 | 10/1974 | Pear | 346/35 |
| 3,910,395 | 10/1975 | Colglazier et al. | 197/1 R |
| 3,918,569 | 11/1975 | Parker | 197/168 |
| 3,948,382 | 4/1976 | Nesbitt et al. | 197/165 |
| 3,964,592 | 6/1976 | Kashio | 197/49 |
| 3,987,137 | 10/1976 | Neumann et al. | 264/113 |

FOREIGN PATENT DOCUMENTS

| | | | |
|---|---|---|---|
| 912319 | 4/1946 | France | 197/151 |

*Primary Examiner*—Ernest T. Wright, Jr.

*Attorney, Agent, or Firm*—Watson, Cole, Grindle & Watson

[57] ABSTRACT

This invention is concerned with a mosaic printer, for example, of the needle print head type which comprises a stationary print head and means for feeding an article, for example a web of paper to be printed, in a direction orthogonal to a row of print devices of the head and in synchronism with operation of the print devices so that, by selective operation of the print devices, the article is provided by the print devices with a pattern which constitutes visual data.

6 Claims, 10 Drawing Figures

Figure 1:
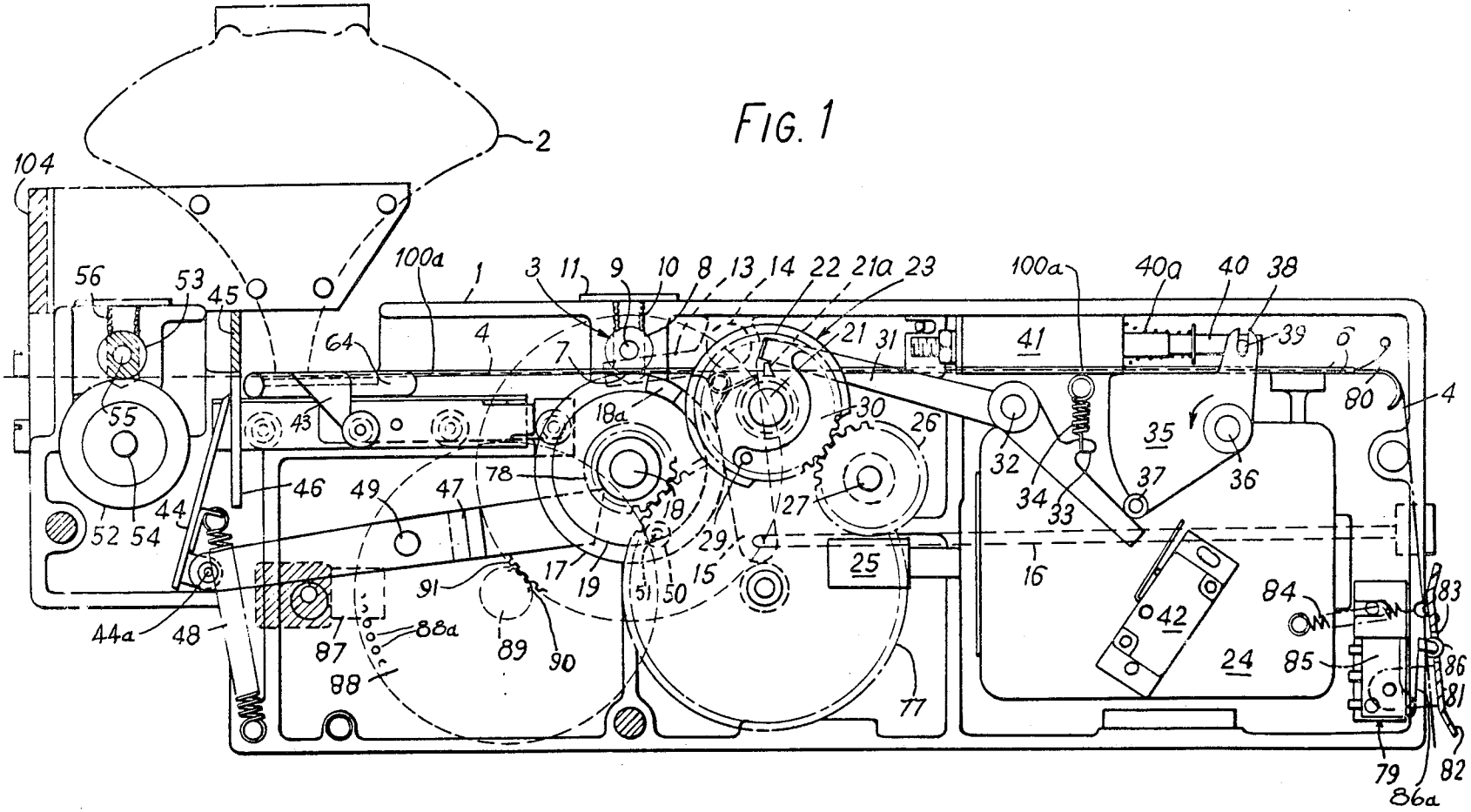

24
41
40
39
35
40a
16
28
23
31
77
27
58
57
91
60
13
21
3
3
76
50
74
18a
73
75
59
12
20
22
9
18
1
9
19
62
88
89
78
17
61
70
90
61
47
49
63
68
65
63
64
5
43
67
68
66
52
45
44
54
55
53

WEB FEED, WEB CUTTING AND RIBBON FEED MEANS FOR A STATIONERY MOSAIC PRINTER

This invention relates to mosaic printers; that is, printers which have a print head comprising a row of needle print heads and arranged so that there is relative movement between the print head and a surface to be printed upon. Selective operation of the print devices at regular intervals of the relative movement causes patterns of holes or ink dots to be built up by the print devices in rows and columns on the surface and the patterns are recognisable as alpha-numeric characters and thus constitute visual data.

Generally mosaic printers are arranged to move relative to a surface to be printed upon while the surface is stationary. When a printer has completed a line of print the surface is moved in a direction at right-angles to the line of print and the printer remains inactive until the surface is again stationary and the printer prints another line of print.

While such printers are satisfactory for some uses, they have a disadvantage in that because the surface to be printed upon is stationary during printing, there is a speed limitation on the output of the printer.

An object of the present invention is to provide an improved mosaic printer.

According to the present invention there is provided a mosaic printer comprising a stationary print head and means for feeding an article to be printed in a direction orthogonal to a row of print devices of the head and in synchronism with operation of the print devices so that by selective operation of the print devices the article is provided by the print devices with a pattern which constitutes visual data.

The speed of movement of the article relative to the print head therefore is not limited as with mosaic printers in which an article is stationary during printing. Furthermore, since the feed means is arranged to feed the article in synchronism with operation of the print devices, there is a direct co-relation between the feed means and means for operating the print devices and any deviation between the two is thereby eliminated or reduced to a minimum.

The print devices may be needles arranged so that when operated they strike the article and produce holes or indentations in the article forming the pattern. On the other hand, if the article is for example associated with a sheet having pressure sensitive self-manifolding qualities, the pattern will be formed by dots of ink exuded from the sheet by impact of the needle.

Preferably, however, the mosaic printer has a needle print head and an ink member arranged so that impact of the needle causes patterns of a surface of the article and the ink member to be brought into contact with one another thereby forming dots of ink on the surface which together form the pattern.

The ink member may be arranged between the article and the needles or, when the article is in the form of a sheet, on the opposite side of the sheet from the needles.

In one embodiment, the ink member is an inked ribbon which is guided between the article and the needles and across the path of movement of the article. The longitudinal axis of the portion of the ribbon which extends across the said path is diagonal to a plane passing through the said portion and extending perpendicular to the upper surface of the said portion and transversely of the said path.

Each end of the ribbon is provided with studs for engaging means for reversing the direction of feed of the ribbon across the path of movement of the article.

Figure 2:
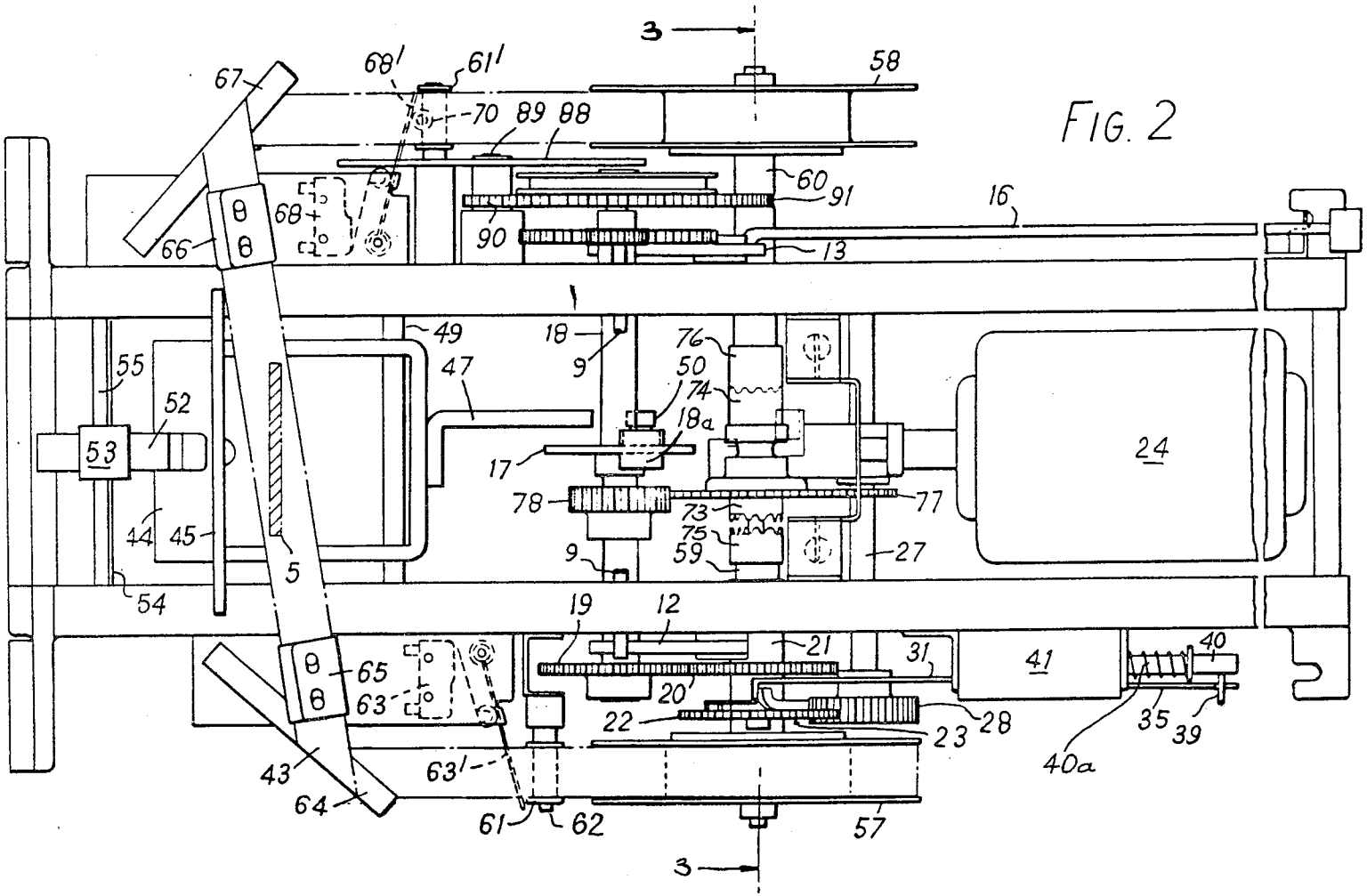
Figure 3:
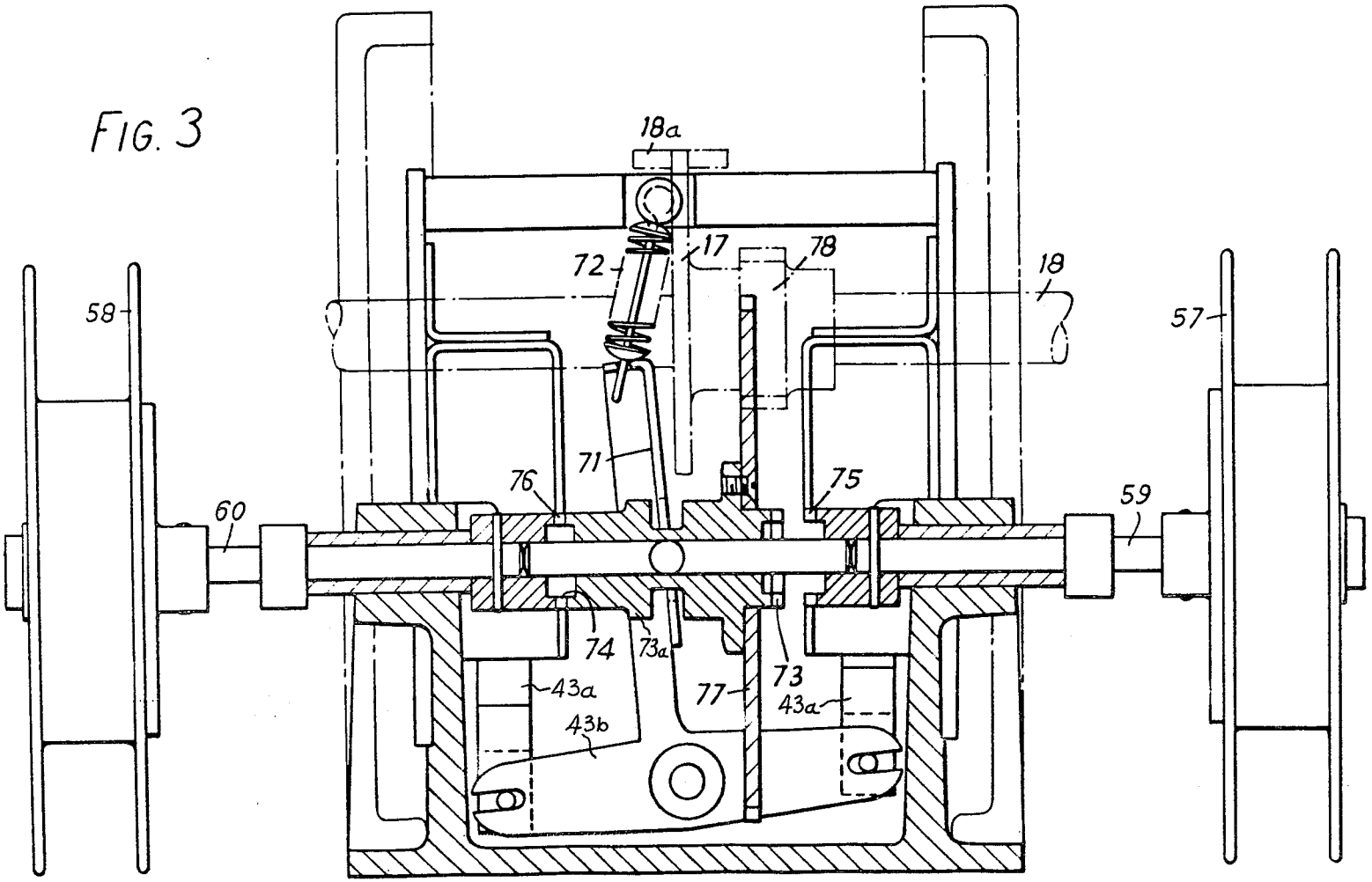
Figure 4:
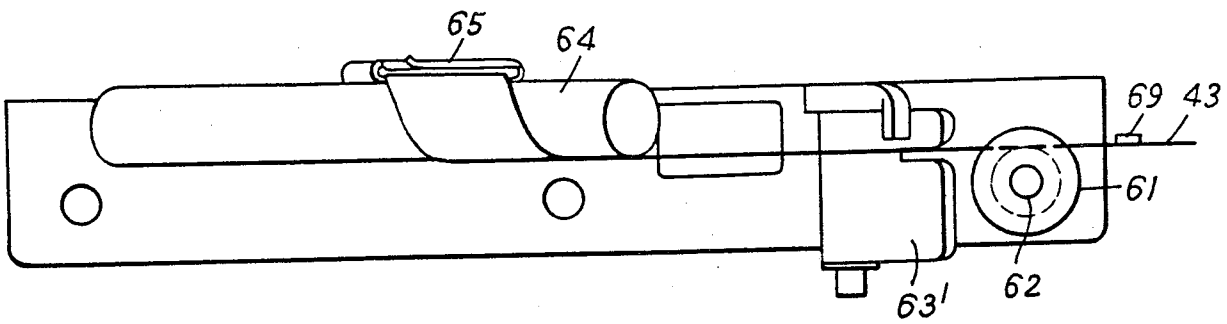
Figure 5:
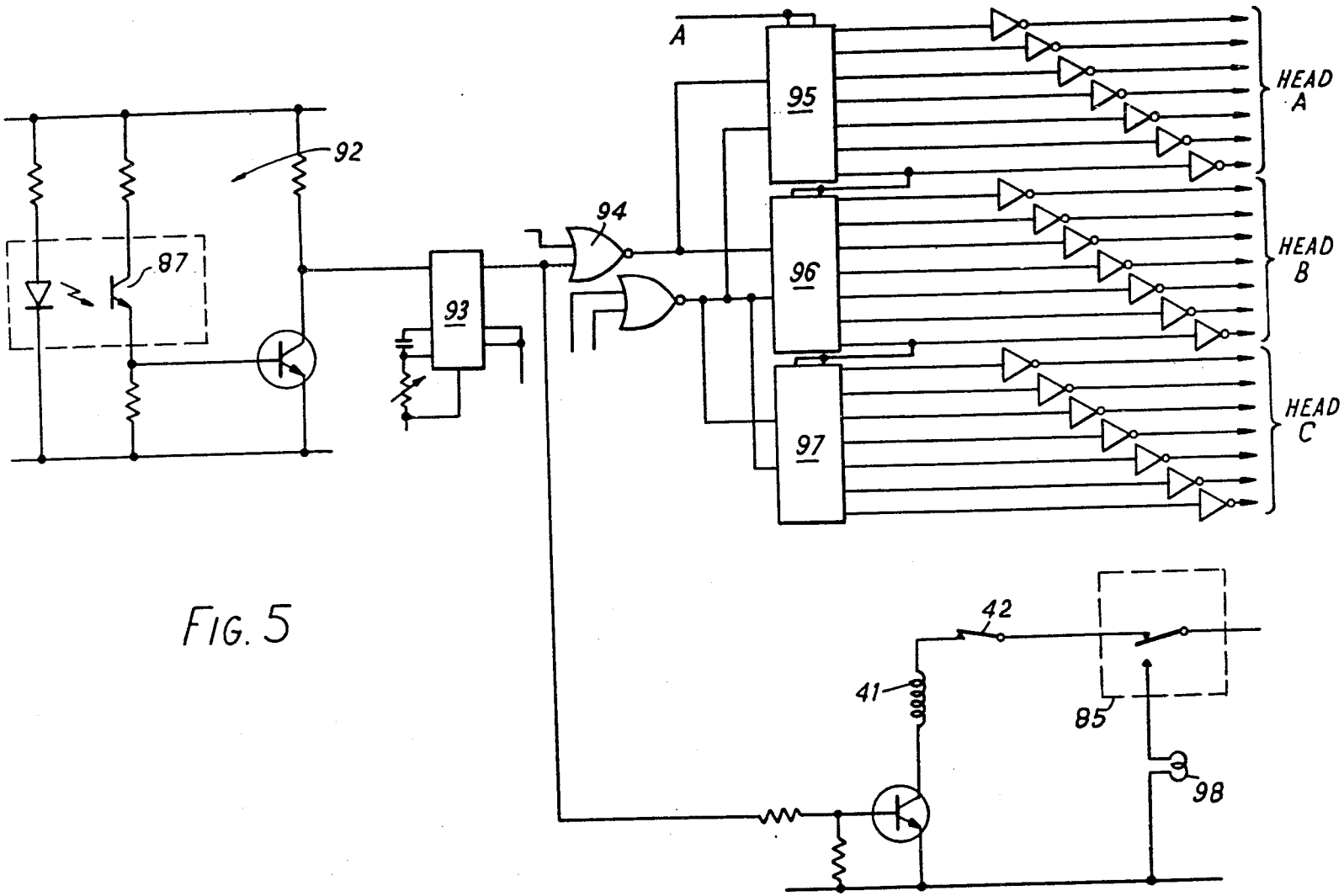
Figure 6:
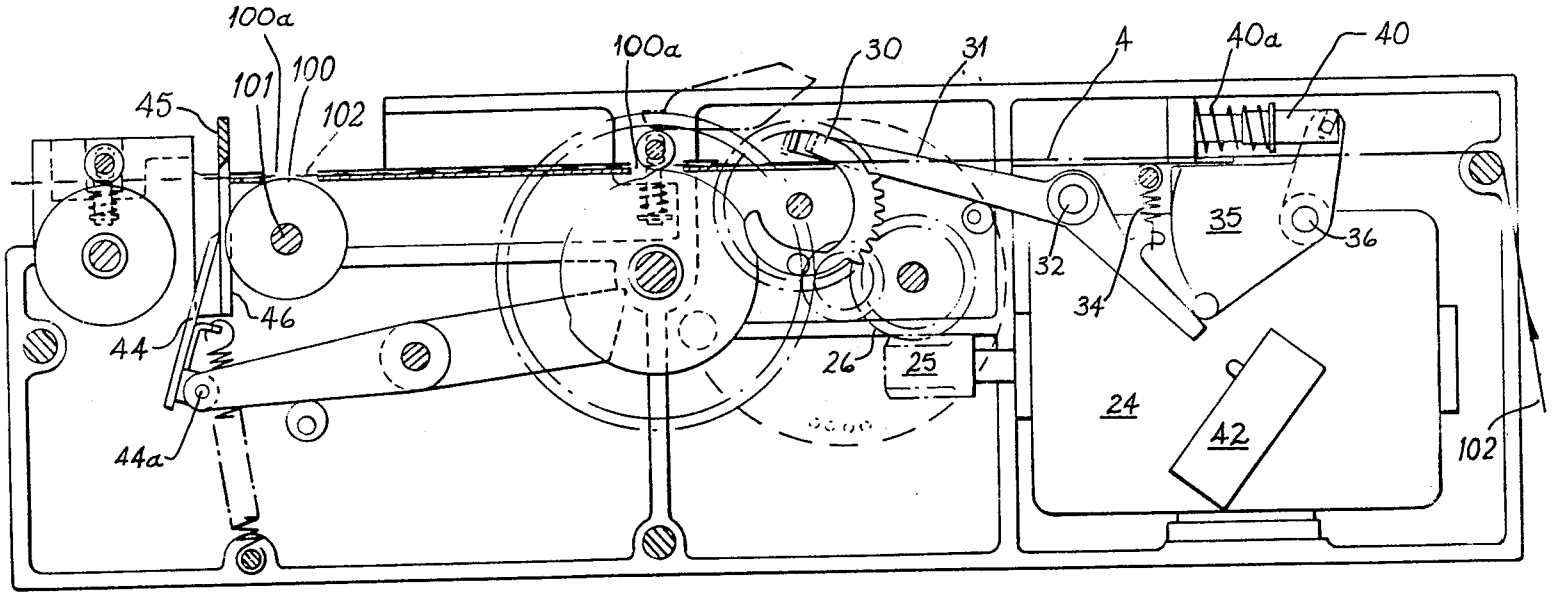
Figure 7:
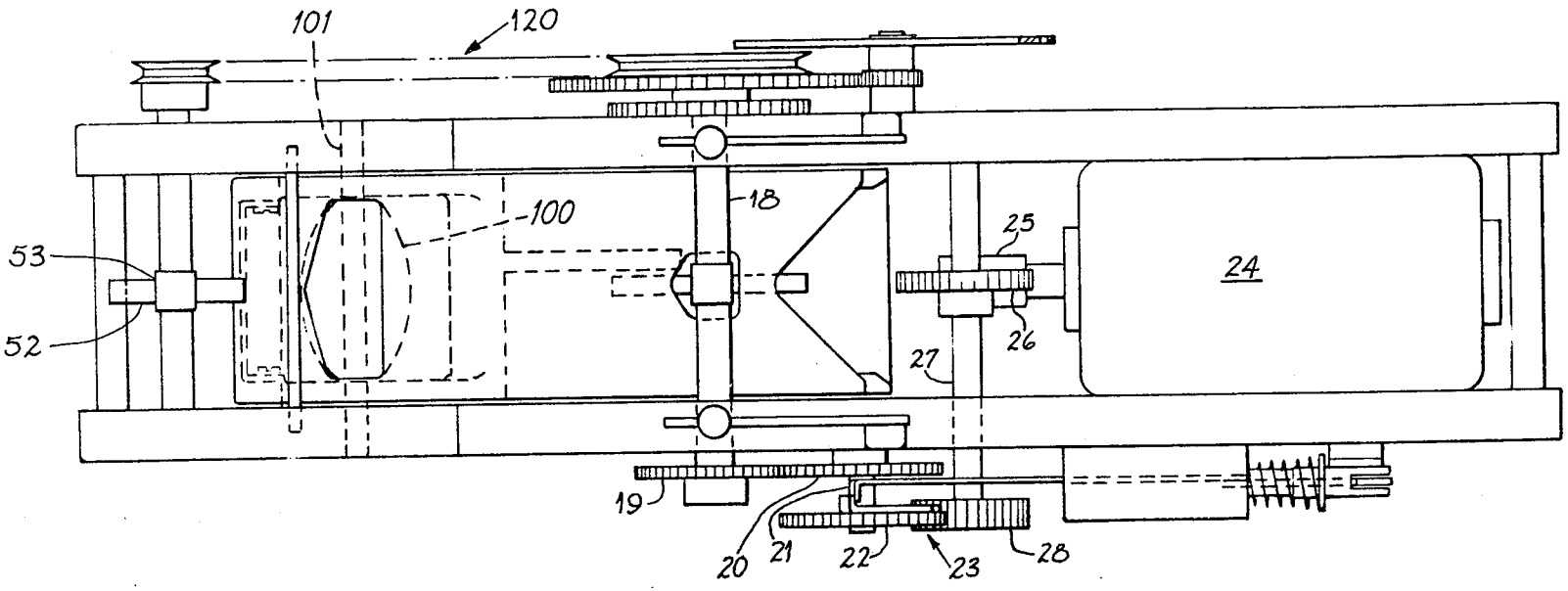
Figure 8:
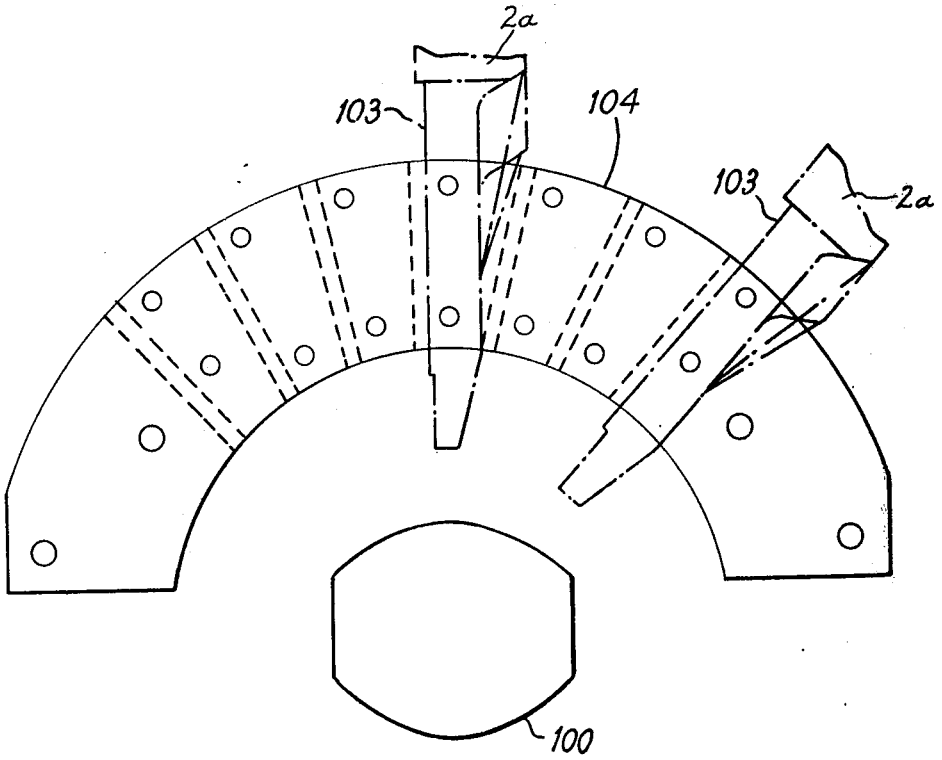
Figure 9:
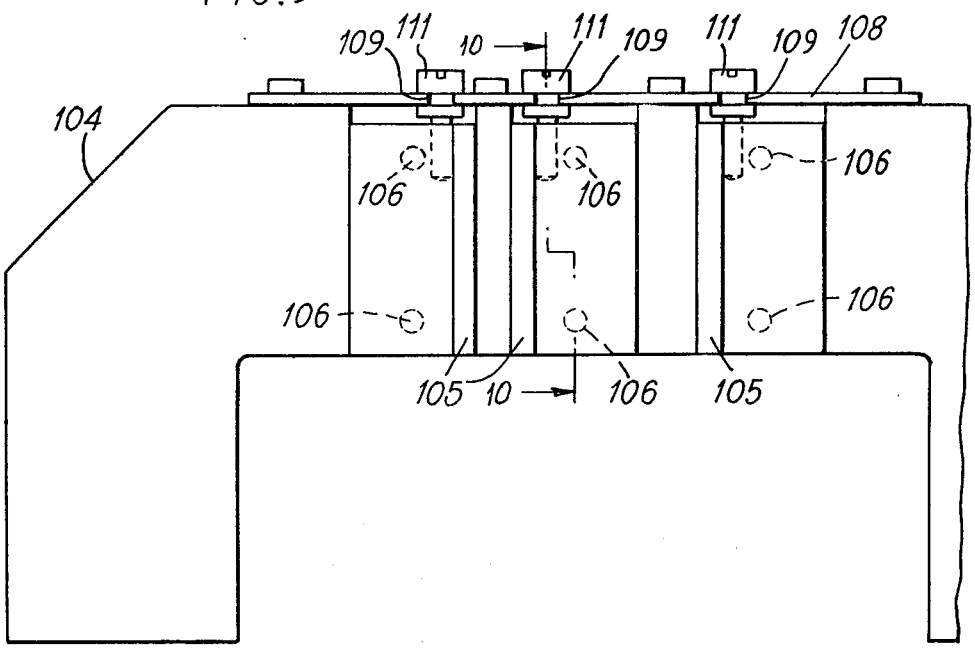
Figure 10:
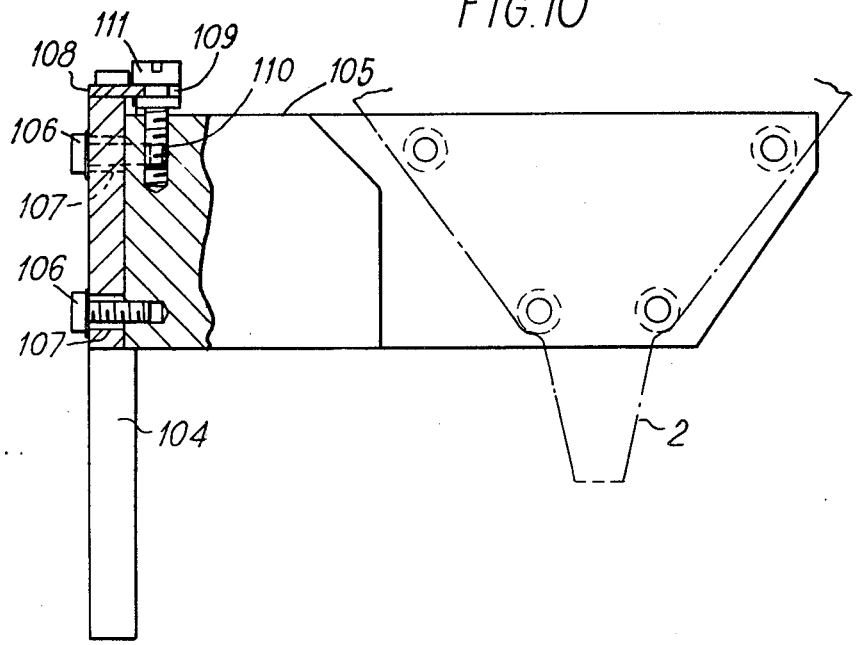

The invention will now be described, by way of example only, with reference to the accompanying drawing in which:

FIG. 1 is a longitudinal cross-section of one example of a mosaic printer in accordance with the invention, FIG. 2 is a plan view of the printer, FIG. 3 is a cross-section on the line 3—3 of FIG. 2, FIG. 4 is a diagrammatic view of an ink ribbon feed mechanism of the printer, FIG. 5 is a diagram of a circuit for synchronising operation of the print devices and a feeding mechanism of the printer, FIG. 6 is a plan view of another example of a mosaic printer in accordance with the invention, FIG. 7 is a plan view of the printer shown in FIG. 6, FIG. 8 is a diagrammatic view of a printing unit of the printer shown in FIGS. 6 and 7, FIG. 9 is a rear view of a support for print heads of a printer in accordance with the present invention, and FIG. 10 is a side view, shown partly in section, of the support taken substantially along line 10—10 of FIG. 9.

Referring to FIGS. 1 to 4, the printer comprises an elongated frame 1 having three needle print heads, generally designated 2, secured to one end of the frame 1 and means, generally designated 3, for feeding a web 4 on which information may be recorded longitudinally of the frame 1 in a direction towards the print heads 2 so that the web 4 passes under the heads 2. Each of the print heads 2 has a row of seven needle print heads 103 (FIG. 8) which extend downwardly towards an anvil 5 (FIG. 2) on the frame 1, the rows of needle print heads being in line with one another and both the anvil 5 and the rows of needle print heads extend transversely of the direction of feed of the web 4.

During movement towards the print heads 2, the web 4 passes through a guideway 6 extending longitudinally of the frame 1 and in which there is a slot 7. Projecting into the slot 7 is a roller 8 secured to a cross shaft 9 journalled in the frame 1. The roller 8 is urged into the slot 7 by means of helical springs 10 which engage the underside of respective plates 11 secured to the frame 1 and bear on the ends of the shaft 9. Extending under opposite ends of the shaft 9 are levers 12 and 13 each secured to a cross shaft 14. The lever 13 has a projecting arm 15 and pivotally connected to the lower end of the arm 15 is one end of an operating rod 16. The other end of the rod 16 is supported in the frame 1.

Below the slot 7 in the guideway 6 is a disc 17 which projects into the slot 7. The disc 17 has a curved flange 18*a* extending radially of a portion of the periphery thereof and the disc 17 is secured to a cross shaft 18 which is journalled in the frame 1. Secured at one end of the shaft 18 is a gear 19. Another gear 20 secured to one end of a stub shaft 21, also journalled in the frame 1, meshes with the gear 19 and also mounted on the shaft 21 is a gear 22 of a one-revolution clutch, generally designated 23.

Since the roller 8 is resiliently urged towards the disc 17, the web 4 is nipped between them and when drive is transmitted through the clutch 23 to the gears 22, 20 and 19 the web 4 will be fed towards the print heads 2. The web 4 is provided with holes 100*a* (FIG. 1 and 6) spaced longitudinally at regular intervals and arranged to coincide with the nip of the roller 8 and disc 17 as the web 4 passes through the nip. When a hole 100*a* coincides with the nip the roller 8 and disc 17 will contact one another through the hole 100*a* and no feeding will take place until the flange 18*a* of the disc 17 engages the underside of the web 4 adjacent the hole 100*a*. Feeding of the web 4 then will occur and the web 4 will be advanced for a short distance until the flange 18*a* has passed beyond the nip. By this time the hole 100*a* would have passed beyond the nip also and feeding of the web 4 will be carried out as before. The longitudinal spacing between holes 100*a* of the web 4 corresponds to ticket lengths since the web 4 after printing will be cut into tickets in a manner to be described later.

Drive to the clutch 23 is supplied from a motor 24 (secured in the frame 1) by means of a worm 25 driven by the motor 24 which meshes with a wheel 26 (secured to a cross shaft 27) and a gear 28 (secured at one end of the shaft 27) which meshes with the gear 22 of the clutch 23.

The one revolution clutch 23 comprises the gear 22, which has a portion of its circumference with no teeth, and a toothed segment 30 pivotally connected at one end as shown at 29 to the gear 22. The segment 30 is urged by spring action to pivot to a position in which it occupies the portion of the gear 22 with no teeth and drive is thereby transmitted to the gear 22 from the gear 28. However, the segment 30 can be prevented from pivoting by means of an actuating lever 31, in which case the gap between the teeth of the gear 22 prevents drive from the gear 28 being transmitted to the gear 22. On the hub of the clutch 23 is a wedge-shaped cam 21*a* which engages the lever 31 once in each revolution of the shaft 21 thereby pivoting the lever 31 into the path of the segment 30 and disengaging the clutch 23. In this manner, the clutch 23 operates for one revolution only (unless the lever 31 is operated as will be described later.)

The actuating lever 31 is pivotally mounted on a stud 32 extending from one side of the frame 1 and has a second arm which is provided with a lug 33. A helical spring 34 which is anchored to the side of the frame 1 is hooked onto the lug 33 and thereby biases the first arm of the lever 31 into contact with the segment 30.

Another two arm lever 35, which is pivotally mounted on a stud 36 extending from the side of the frame 1, has a cam follower 37 rotatably mounted on one arm and the other arm has a forked end 38 in which is received a lug 39 of an armature 40 of a solenoid 41. Below the lever 35 is a switch 42 which is operated by the lever 35 when the armature 40 is fully drawn into the solenoid 41 and the lever 35 has been pivoted in an anti-clockwise direction (see FIG. 1) about the stud 36. The switch 42 is a double pole switch, one pair of poles thereof being connected in circuit with the solenoid 41 (see FIG. 5), and the other pair of poles thereof being connected in circuit with the motor 24 (not shown in FIG. 5), the arrangement being such that when the switch 42 is operated current to the solenoid 41 is cut off but current to the motor 24 is switched on. In this manner, after the solenoid 41 has been operated thereby pivoting the lever 35 and causing movement of the cam follower 37 to pivot the lever 31 against the bias of the spring 34 and release the clutch 23, the cam follower 37 engages and operates the switch 42 thereby cutting off supply to the solenoid 41 and starting the motor 24. The lever 31 subsequently is pivoted in a reverse direction by the spring 34 when the cam follower 37 rolls off the end of the lever 31. In this manner, the cam follower 37 is prevented by the lever 31 from moving away from the switch 42 and the switch 42 is thereby held on.

After one revolution of the shaft 21, the wedge-shaped cam 21*a* pivots the lever 31 against the action of the spring 34 into the path of the segment 30 thereby disengaging the clutch 23. In consequence of the lever 31 pivoting, the cam follower 37 is disengaged by the lever 31 and the lever 35 is returned to the position shown in FIG. 1 due to a helical spring 40*a* co-axial with the armature 40 of the solenoid 41. The cam follower 37 thus rides back onto the lever 31.

Web advancement towards the print heads 2 is thereby controlled incrementally and each advancement is arranged to correspond with a length of the web 4 between successive holes 100*a*, the length being a "ticket" length.

On passing below the print heads 2, the web 4 receives a print impression by the needle print heads 2 which strike an inked ribbon 43, arranged above the anvil 5 between the needle print heads 2 and the web 4, against the web 4 thereby extruding ink from the ribbon 43 in the area of impact on the web 4. Arrangement of the inked ribbon 43 will be described in more detail later.

After having been printed by the heads 2, each ticket length is severed from the web 4 by a guillotine blade 44 which co-operates with a stationary blade 45 arranged above the path of movement of the web 4. Each end of the blade 45 has downwardly extending guides 46. The guillotine blade 44 is pivotally mounted on one end of a forked lever 47 and is urged about its pivot axis 44*a* towards the guides 46 by a helical spring 48 so that the cutting edge of the guillotine blade 44 engages the guides 46. One end of the spring 48 is secured to the blade 44 and the other end is anchored to the base of the frame 1. The lever 47 is pivotally mounted between its ends on a cross shaft 49 and the end of the lever 47 distant from the blade 44 is in the orbit of a cam follower 50 rotatably mounted on a stub shaft 51 extending from one side of the disc 17. When the disc 17 is rotated by the shaft 18, the follower 50 thus engages and pivots the lever 47 about the shaft 49 thereby moving the guillotine blade 44 upwardly along the guide 46 and against the bias of the spring 48. The guillotine blade 44 co-operates with the stationary blade 45 and thereby severs a ticket length from the web 4. As the follower 50 rolls off the lever 47, the lever 47 is released and pivots in a reverse direction to its initial position due to the bias of the spring 48.

On the outfeed side of the guillotine blade 44 is a pair of co-operating rollers 52 and 53 secured to cross shafts 54 and 55 respectively in the frame 1 and arranged so that the nip of the rollers 52, 53 is in line with the direction of feed of the web 4. The upper roller 53 is spring loaded towards the lower roller 52 by means of springs 56 bearing on the shaft 55 and the lower roller 52 is driven by a belt and pulley arrangement 120 (FIG. 7) from the shaft 18 at a higher speed than the shaft 18 thus keeping tension on the ticket to assist cutting and, when cut, to eject the ticket.

Pulleys or ribbon spools 57 and 58 are secured to the outer ends of the stub shafts 59 and 60 respectively which are journalled in the sides of the frame 1, the pulleys 57, 58 being arranged to support opposite ends of the ribbon 43. The ribbon 43 is fed from the pulley 57 over a guide pulley 61 rotatably mounted on a stub 62 secured to the frame 1 through an eye of a microswitch lever 63' around a bar 64 extending at an angle to the side of the frame 1, through guides 65, 66 on the top of the frame 1 and across the direction of the feed of the web 4. On the other side of the frame 1 the ribbon 43 is similarly fed through an eye of a microswitch lever 68' and over a guide pulley 61' to the pulley 58. The angled bar 67 is secured to the frame 1 in a position nearer the guillotine blade 44 than the position of the angled bar 64. In this manner, the longitudinal axis of the portion of the ribbon 43 which extends across the direction of the feed of the web 4 is diagonal to a vertical plane passing through the anvil 5 and extending transversely to the direction of the feed of the web 4. Near each end of the ribbon 43 are studs 69 and 70 which are secured to the ribbon 43. The arrangement is such that the studs 69 and 70 will not pass through the eyes of the levers 63' and 68' respectively but instead engage the levers 63', 68' and move them thereby operating the micro-switches 63, 68 to which they are attached.

The levers 63' and 63' (FIG. 2) each form a part of corresponding microswitches 63, 68 respectively which are secured to the frame 1 and which are electrically connected to solenoids 43*a* (FIG. 3) for reversing the direction of movement of the ribbon 43. A T-shaped lever 43*b* associated with the reversal solenoids 43*a* is connected to a tumbler switch 71 having an overcenter spring 72, one of the reversal solenoids 43*a* being controlled by the microswitch 63 and the other of the reversal solenoids 43*a* being controlled by the microswitch 68. The tumbler switch 71 is provided with a shaft 73*a* having dogs 73 and 74 provided at opposite ends. Dogs 75 and 76 also are provided at the inner ends of the shafts 59 and 60 respectively. When the tumbler switch 71 is in the position shown in FIG. 3, the dog 74 of the switch 71 is in mesh with the dog 76 of the shaft 60 and when the tumbler switch 71 is in a second position the dog 73 of the switch 71 is in mesh with the dog 75. The tumbler switch 71 is associated with a gear 77 which is in mesh with a pinion 78 on the shaft 18 and thus is driven from the shaft 18.

When an end portion of the ribbon 43 is unwound from one of the pulleys 57 and 58, the stud 69 or 70 at that end portion engages one or the other of the microswitch levers 63' or 68' and moves such lever 63' or 68' thereby operating the microswitch 63 or 68 associated with the lever 63' or 68'. As a result, the solenoid 43*a* connected with the microswitch 63, 68 is actuated and the tumbler switch 71 is shifted to the opposite position whereby drive to one of the pulleys 57 or 58 is disengaged and connected to the other of the pulleys 57 or 58. The process is repeated each time an end portion of the ribbon 43 is unwound from the pulleys 57, 58.

The ribbon 43 together with the pulleys 57 and 58 and the shafts 59 and 60 preferably together form a single unit which can be attached (by screws for example) to and removed from the frame 1.

By virtue of the direction of the feed of the ribbon 43 being oblique to the direction of the feed of the web 4, the whole width of the ribbon 43 is used when it is struck by the needles of the print heads 2.

Although not shown in the drawing, the web 4 is folded concertina fashion into a pack. The leading edge of the web 4 is fed from the pack through a "last ticket switch", generally designated 79, under a tension brush 80 and into the guideway 6. The operating rod 16 is pushed thereby causing the levers 12 and 13 to lift the shaft 9 and thereby raise the roller 8 from contact with the disc 17 and the leading edge of the web 4 is pushed between the roller 8 and the disc 17 until the edge abuts the cutting edge of the guillotine blade 44. The operating rod 16 then is released and the web 4 is nipped between the roller 8 and the disc 17 and feeding of the web 4 can be carried out as described above.

The "last ticket switch" 79 is shown in FIG. 1. It comprises a plate 81 having an inclined portion 82 at one end and a slot 83 in the center. The plate 81 is pivotally connected near the portion 82 to the frame 1 and is resiliently biased, by means of a helical spring 84, so that the end distant from the portion 82 is urged against the frame 1.

A microswitch 85 is provided on the frame 1 and has a roller 86 rotatably secured to its actuating arm 86*a*. The arrangement is such that the roller 86 projects through the slot 83 in the absence of a web 4 and the switch 85 then is in an inoperative condition. By feeding the leading edge of the web 4 under the plate 81 as far as the roller 86 and pressing the inclined portion 82, the plate 81 is pivoted against the resilient bias away from the frame 1. The leading edge of the web 4 can then be grasped and fed under the tension brush 80 and into the guideway 6. When the plate 81 is released it snaps onto the web 4 and the web 4 blocks the slot 83 of the plate 81 thereby urging the roller 86 inwardly and operating the microswitch 85. When the trailing edge of the web 4 leaves the plate 81, the slot 83 is cleared and the roller 86 again snaps into the slot 83 with a result that the microswitch 85 becomes inoperative.

Feeding of the web 4 is synchronised with operation of the print head 2 by means of a light emitting diode (LED) and photocell transducer 87 arranged to cooperate with holes 88*a* spaced equi-distant around the periphery of a timing disc 88 which is driven in synchronism with the feeding of the web 4. This is achieved by securing the disc 88 to a cross shaft 89 of the frame 1. On the shaft 89 there is also secured a gear 90 which is in mesh with a gear 91 secured to the shaft 18 on which the web feed disc 17 also is secured. In this manner the timing disc 88 is rotated in synchronism with the feed disc 17.

Referring now to FIG. 5, the transducer 87 is shown included in a circuit 92 which supplies a driver circuit 93. Pulses from the driver circuit 93 pass to the solenoid 41 and through a NOR gate 94 to strobe shift registers 95, 96 and 97 controlling operation of the actuating solenoids 2*a* of the needle print heads 2. A pulse stream from a generator circuit is fed into the shift registers 95, 96, 97 at A to set up the registers 95, 96, 97 for operating appropriate actuating solenoids 2*a* for each print operation but the needle print heads 103 are not fired until the shift registers 95, 96, 97 are strobed. This will occur when the transducer 87, under the control of the timing disc 88, supplies the driver circuit 93.

When the trailing edge of the web 4 leaves the microswitch 85, the microswitch 85 is rendered inoperative and "breaks" the circuit containing the solenoid 41 and the switch 42 but "makes" a circuit containing a "paper out" lamp 98. Consequently current is supplied to the lamp 98 and the lamp 98 is illuminated. It will be appreciated that with the ribbon feed described above, the ribbon 43 is restricted from travelling at right angles to its longitudinal axis and yet maximum tension of the ribbon 43 is ensured due to drag provided by the unwinding pulley 57 or 58. In this manner, the ribbon 43 is maintained taut under the print heads 2 to give good quality printing.

Furthermore, it will be appreciated that because the guillotine blade 44 is biased towards the guides 46, the angle of the blade 44 on approaching the stationary blade 45 is such as to give the most satisfactory shearing action which also tends to be self sharpening.

Referring to FIGS. 6 to 8, there is shown another example of the printer according to the present invention. Instead of having the inked ribbon 43, the printer shown in FIGS. 6 to 8 has an inked roller 100 which is rotatably mounted on a cross shaft 101 extending transversely of and below the direction of feed of a web 102 which is to be printed on by the printer. The shaft 101 is positioned so that a portion of the periphery of the roller 100 is in the same position in the printer as the anvil 5 in the example described with reference to FIGS. 1 to 5. Printing is effected by the needle print heads 103 mounted on a gantry 104 provided on the printer above the roller 100. The printer is otherwise the same as in FIG. 1.

In operation, because the roller 100 is positioned below the web 102, ink exuded from the roller 100 by impact of the needles pressing the web 102 against the roller 100 will be received on the underside of the web 102 in patterns constituting alpha numeric characters as the web 102 moves under the print heads 103.

By providing an inked roller 100 it is possible to provide more print heads 103 than can be provided with the example of the printer described with reference to FIGS. 1 to 5. This is because more print heads 103 can be provided in a width of the web 102 if the print heads 103 are arranged in an arc above the roller 100 than if they are arranged in a rectilinear row. In such a case, the roller 100 is provided with a barrel shaped cross section to conform with the arcuate arrangement of the print heads 103 (see FIG. 8).

Referring now to FIGS. 9 and 10, there is shown a gantry for supporting needle print heads 103 of a printer according to the present invention. The gantry comprises a bracket 104, which is secured to the frame 1 (see FIG. 1) of the printer and extends transversely of the direction of feed of the web 4, and a plurality of cradles 105 for the print heads 2 respectively which are secured to the bracket 104 by means of bolts 106 the shanks of which pass through holes 107 in the bracket 104. On the upper edge of the bracket 104 there is a flange 108 which is provided with a row of apertures 109. Each of the cradles 105 has a tapped recess 110 in the upper edge thereof. The recesses 110 receive the shanks of bolts 111 which pass through the apertures 109. By turning the bolts 111, the cradles 105 can be raised or lowered thereby adjusting the operating position of the needles relative to the web 4. The adjustment is possible because of the slots 107 in the bracket 104.

What we claim is:

1. A mosaic printer, comprising, stationary print head means including a plurality of needle print heads arranged in a row, means for feeding a ticket web one ticket length at a time to be printed with equispaced repeat ticket lengths in a direction orthogonal to the row of needle print heads, the print heads being arranged so that impact thereof causes visible dots to be formed on the surface of the web in a pattern which constitutes visual data, the web having holes therein spaced in the feed direction of the web, the feeding means comprising a drive motor, a rotatable drive member driven by the drive motor for engaging the web to thereby feed the web, said drive member comprising a rotatable drive disc having a flange extending radially of a portion of the periphery of the disc, and a one-revolution clutch connected between the motor and the drive member for driving the web for the one ticket length thereof, the clutch being arranged so that the drive disc feeds the web until one of the holes therein is located adjacent the drive disc whereupon the feeding is halted until the flange engages the sides of the one hole to drive the web for the one ticket length thereof.

2. A mosaic printer according to claim 1 wherein there is provided a timing device operable in synchronism with the drive disc, the timing device controlling operation of the needle print heads so that operation of the needle print heads is synchronised with feeding of the ticket web.

3. A mosaic printer according to claim 2 wherein there is provided an ink ribbon, at least a portion of which extends between the web and the print heads across the feed direction of the web, said ink ribbon portion being arranged so that impact of the needle print heads causes patterns of a surface of the web and the ink ribbon to be brought into contact with one another thereby forming dots of ink on the surface of the web which together form the pattern.

4. A mosaic printer according to claim 3 wherein the longitudinal axis of said portion of the ribbon which extends across the feed direction of the web is diagonal to a plane passing through the portion and extending perpendicular to the upper surface of the portion and transversely of the feed direction.

5. A mosaic printer according to claim 2 wherein an inked roller which is barrel shaped in cross section is provided on one side of the web and the needle print heads arranged in an arc above the roller are provided on the opposite side of the web.

6. A mosaic printer according to claim 1 wherein there is provided a guillotine operable in synchronism with the web feeding means and with the needle print heads so that the web may be cut into sheets as the web moves away from the needle print heads.

* * * * *